United States Patent [19]

Keprda

[11] 4,095,060

[45] * June 13, 1978

[54] SLIDE SWITCH ASSEMBLY HAVING TERMINALS FOR MOUNTING SWITCH HOUSING SIDEWALL PARALLEL TO A PRINTED CIRCUIT BOARD

[75] Inventor: Jaroslav Keprda, Munich, Germany

[73] Assignee: Siemens Aktiengesellschaft, Berlin & Munich, Germany

[ * ] Notice: The portion of the term of this patent subsequent to Aug. 10, 1993, has been disclaimed.

[21] Appl. No.: 710,878

[22] Filed: Aug. 2, 1976

Related U.S. Application Data

[63] Continuation-in-part of Ser. No. 540,558, Jan. 13, 1975, Pat. No. 3,974,346.

[30] Foreign Application Priority Data

Sep. 5, 1975 Germany ..... 2539581

[51] Int. Cl.[2] ..... H01H 15/02; H01H 1/00; H01H 9/02

[52] U.S. Cl. ..... 200/16 D; 200/284; 200/294

[58] Field of Search ..... 200/6 B–6 C, 200/11 D, 11 DA, 14, 16 C, 16 D, 11 J, 294–296, 284

[56] References Cited

U.S. PATENT DOCUMENTS

| | | | |
|---|---|---|---|
| 3,193,629 | 7/1965 | Losch et al. | 200/14 X |
| 3,525,827 | 8/1970 | Allison | 200/295 X |
| 3,609,258 | 9/1971 | Leland | 200/11 DA |
| 3,735,059 | 5/1973 | Glaser et al. | 200/16 C |
| 3,792,206 | 2/1974 | Purdy | 200/6 B |
| 3,878,344 | 4/1975 | Lockard | 200/6 B |
| 3,974,346 | 8/1976 | Keprda | 200/16 D X |
| 3,974,347 | 8/1976 | Lockard | 200/16 D |

*Primary Examiner*—James R. Scott

*Attorney, Agent, or Firm*—Hill, Gross, Simpson, Van Santen, Steadman, Chiara & Simpson

[57] ABSTRACT

An improved switch assembly incorporating a plurality of sliding switch subassemblies which each move between two switching positions by means of a contact slider. Each switch subassembly is provided with a pair of contact elements which are each provided with spaced extensions that are arranged to permit such contact elements to be coplanar interiorly of the housing of the switch assembly and to be extensible from the housing exteriorly thereof so as to be engagable with a carrier plate and solderable thereto. The individual switch subassemblies are adjustable without difficulty with the switch assembly engaged with such carrier plate.

2 Claims, 3 Drawing Figures

SLIDE SWITCH ASSEMBLY HAVING TERMINALS FOR MOUNTING SWITCH HOUSING SIDEWALL PARALLEL TO A PRINTED CIRCUIT BOARD

RELATED APPLICATION

The present application is a continuation-in-part of my earlier filed application U.S. Ser. No. 540,558, filed Jan. 13, 1975, now U.S. Pat. No. 3,974,346 issued Aug. 10, 1976.

BACKGROUND OF THE INVENTION

In German Offenlegungsschrift No. 2,402,173 is shown, for example, a switch arrangement wherein the individual switches can be activated with the aid of slide contacts whose activating nipples are accessible on a side of the switch housing facing away from the base plate of the switch. The terminal connection elements of the switches protrude from the housing parallel to the base plate of the housing of the switch arrangement and are angled in such a way that the switch arrangement can be put, with the base plate of the housing, onto a conductor plate when the terminal connection elements are inserted into the pattern of holes formed in the conductor plate. The individual switches of such a switch arrangement connected to such a conductor plate are therefore activated parallelly to the surface of the conductor plate. This means, however, that one is generally forced, for an adjustment of the switches of such a switch arrangement, to pull the conductor plate involved out of a plug-in or slide-in frame, since, because of the relatively close arrangement next to one another of the conductor plates in a rack or housing, a sufficient access to the activating nipples of the individual switches of the switch arrangement is otherwise not possible.

BRIEF SUMMARY OF THE INVENTION

This invention relates to a switch assembly consisting of a plurality of slider switches arranged next to one another in a block shaped housing, each switch being activatable transversely to the longitudinal extension of the housing. Contact surfaces for each switch are set into a floor of the housing and associated with the individual switches, form the fixed contacts of the switches. Such contact surfaces are each joined in one piece to a terminal connection element which is adapted for insertion into a predetermined hole in a carrier or conductor plate.

A primary object of this invention is to provide, in a switch of general class above described, without fundamental alteration of such switch construction, individual switches arranged so as to be activatable without difficulty even in the plugged-in state of a conductor plate, and without the mechanically robust and electrically safe-operating attachment of the switch to a conductor or contact plate being thereby impaired.

Inventively, the accomplishment of this objective results from the fact that in the present invention, a switch housing sidewall running perpendicularly to the housing floor is provided with several outwardly extending spacer bodies distributed over its edge and directed parallel to the housing floor. The terminal connection elements of the individual contact surfaces extend at a greater distance from this sidewall. Suitable extension sections pass between adjacent contact pairs and extend coplanar to the terminal connection elements of these contact surfaces, out of the housing. In each case, one terminal connection element of a terminal connection element pair associated with each one of the slider switches is staggered, as opposed to the other connection element, in the space formed by the spacer bodies, transversely at the end relative to the longitudinal extension of the housing, by means of a correspondingly dimensioned offset.

Such a switch assembly makes it possible to place the assembly housing sidewall which is provided with spacer bodies onto a predetermined conductor plate in such a manner that the terminal connection elements of the individual switches of the switch assembly can essentially be plugged into the holes patterned in the conductor plate, the conductor plate surface being bordered by the spacer bodies. By means of soldering of the terminal connection elements in the holes of the conductor plate, the housing is thus attachable to the conductor plate via the spacer bodies. The individual switches of the switch assembly may now be easily activated at right angles (perpendicularly) to the conductor plate without the danger that the housing of the switch arrangement can be tilted, relative to the conductor plate, by the pressure exerted on the housing during activation. In addition, it is now possible to attach a switch assembly which is constructed in such a fashion, for example, to a conductor plate near the open side of a slide-in frame, so that the individual switches of the switch assembly can be easily activated, i.e. shifted, from the outside, even with the conductor plate being in position relative to such slide-in frame.

DETAILED DESCRIPTION

Figure 1:
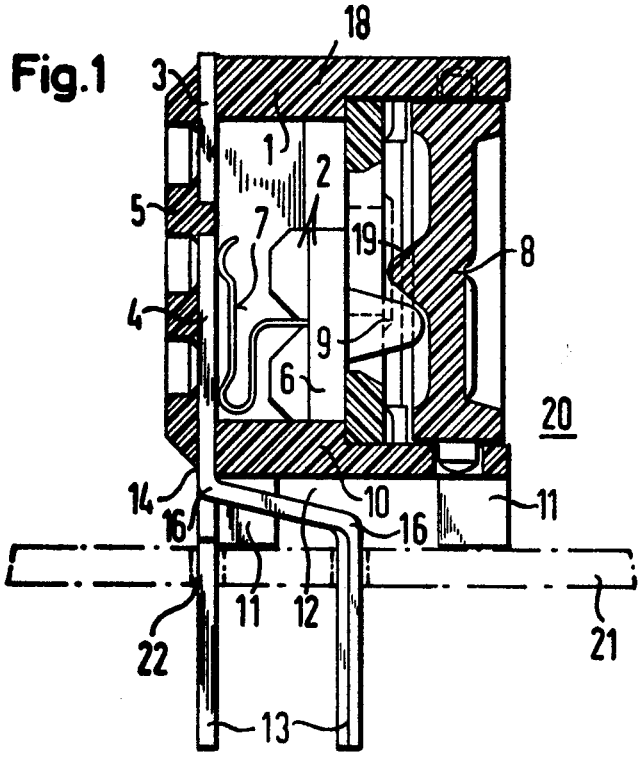
FIG. 1 is a cross sectional through one embodiment of a switch assembly of this invention.
Figure 2:
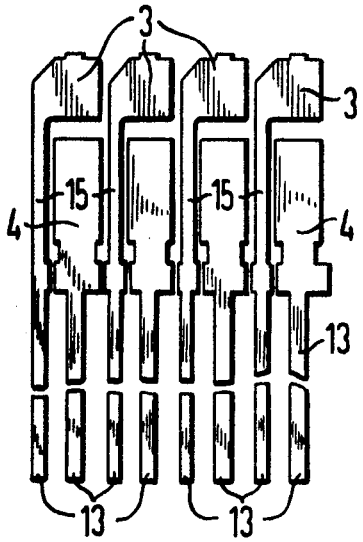
FIG. 2 is a diagrammatic plan view showing the arrangement of the connecting elements employed in such switch assembly.
Figure 3:
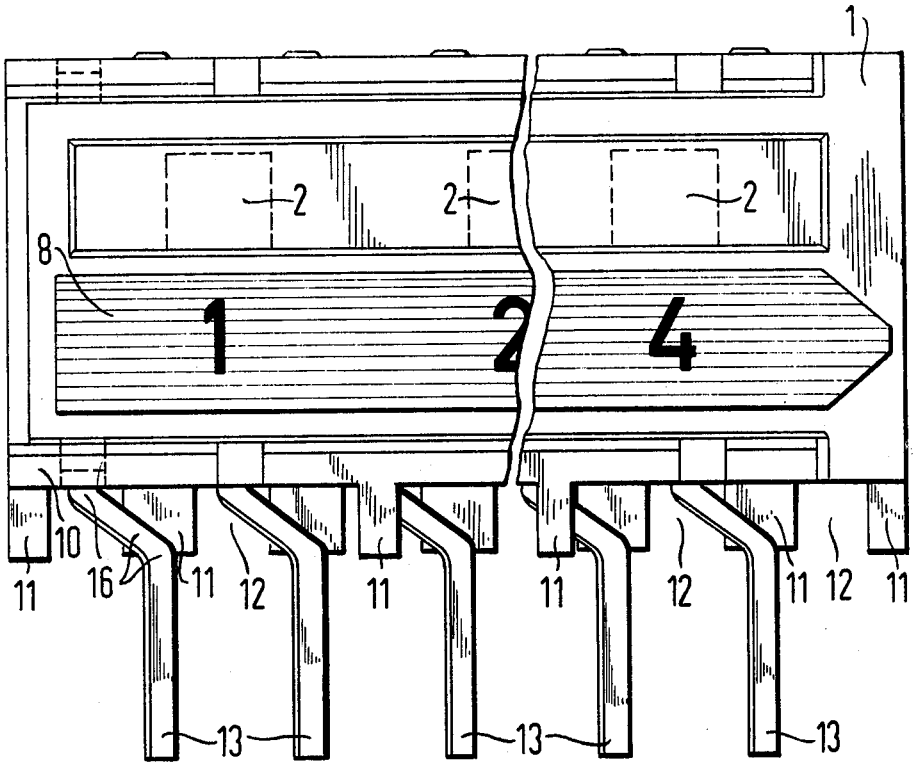
FIG. 3, is a plan view of the switch assembly of FIG. 1, some parts thereof broken away.

Referring to the drawings, there is seen a greatly enlarged embodiment of a switch assembly of this invention which is herein designated in its entirety by the numeral 20. Switch 20 incorporates a generally block-shaped housing 1 comprised of electrically insulative material, such as a molded or cast resin or the like. Housing 1 holds a plurality of slider switch subassemblies 2, the switch subassemblies 2 being arranged in generally spaced, parallel relationship to one another, each being mounted within housing 1 and adapted for sliding movements therein in directions transverse to the longitudinal extension of housing 1 (the regions of the individual switch subassemblies 2 being indicated in FIG. 3 by dotted lines). For each switch subassembly 2, a pair of electrically conductive contacts 3 and 4 are provided; with the respective surfaces of contacts 3 and 4, electrical contact is made. All contacts 3 and 4 are inset into the floor portion 5 of housing 1. Each switch subassembly 2 incorporates an electrically conductive contact bridge 7 which is operatively engaged with a contact slider 6, the latter being conveniently comprised of electrically insulative material, such as a molded or cast resin or the like. Slider 6 is movable between two switching positions. In one such switching position, the respective two contact surfaces of a pair of contacts 3 and 4 are in slidable contact with contact bridge 7, while in the other such switching position, the contact bridge slidably contacts only contact 4 so that connection between contacts 3 and 4 is interrupted (this interrupted position being shown in FIG. 1). Each contact slider 6 is provided with an integrally formed protruding nipple 9 located in relation to housing 1 so as to be accessible on the side thereof opposed to floor portion 5. Such opposed side of housing 1 is provided with a removable cover 8 which when opened permits setting of a switch subassemblies 2 as desired and which when closed interlocks each switch subassembly 2 in such desired position through engagement with camming lobe 19 on cover 8.

Housing 1 is provided with integral opposed side walls 10 and 18. Side wall 10 is provided with a plurality of integrally formed spaced spacer bodies 11 each of which extends outwardly from the sidewall 10. In embodiment 20, the spacer bodies 11 are arranged into two rows, each row being adjacent a different longitudinal side edge of side wall 10. All spacer bodies 11 extend an equal distance outwardly from side wall 10. In this manner, a space 12 is defined between the side wall 10 and a predetermined conductor plate such as a printed circuit board 21, or the like, when the spacer bodies 11 are engaged with such conductor plate.

Each of the contacts 3 and 4 is integrally connected with a terminal connection element 13 and all such terminal connection elements 13 are positioned so as to be insertable into preformed pattern holes, such as holes 22, of the conductor plate or board 21. The terminal connection elements 13 extend laterally out of the housing 1 coplanarly to the contacts 3 and 4 at the edge 14 of the housing 1, edge 14 being formed by the floor 5 and the side wall 10. In order to make this possible, the terminal connection elements 13 of the contacts 3 which are more distant from the side wall 10 are conveyed thereto with integral extension sections 15 that extend between the adjacent contacts 4 in the housing floor.

Outside the housing 1, but inside the space 12 formed by the spacer bodies 11 between the conductor plate or board 21 and the housing side wall 10, the terminal connection element 13 of each contact 4 is provided in each instance with an offset 16. This offset 16 is dimensioned in such a way that each switch terminal connection element 13 belonging to a respective contact 4 is aligned as it extends transversely to the longitudinal extension of the switch 20, with the terminal connection element 13 belonging to a contact 3 (compare especially FIG. 3 in this regard). In addition, each terminal connection element 13 belonging to a respective contact 4 is positioned relative to the offset 16 in such a way that it extends generally true to the pattern set by the terminal connection elements 13 belonging to the individual respective contacts 3. In this regard, the terminal connection elements 13 provided with the offset 16 extend away from the housing 1 approximately in the longitudinal middle region of the zone bordered by the spacer bodies 11. The distance interval between the respective contacts 4 in the housing 1, and the size of these contacts 3 and 4 can thus be selected independently of a pattern-true arrangement of the terminal connection elements 13.

Thus, the switch assembly embodiment includes an elongated block-shaped housing having generally spaced, parallel side walls, and end walls, with a floor joining such side walls and end walls, and with a removable cover in spaced relationship to such floor. In the housing, are a plurality of slidable switch subassemblies, each one being transversely positioned interiorly of said housing in longitudinally spaced relationship to one another relative to such housing. Each switch subassembly is adapted for transverse sliding movement between two positions. Each switch subassembly includes an electrically insulative slider member, and an electrically conductive contact bridge associated functionally with such slider member. Mounted in the floor of the housing are a pair of flattened, electrically conductive contact elements for each one of said switch subassemblies. Relative to each other, each one of said pair of contact elements is in transversely spaced, coplanar relationship in the housing, and each such pair is adapted to have respective surface portions thereof engaged said contact bridge of each associated said switch subassembly when such switch subassembly is in one of said positions only. A plurality of first terminal connection elements are provided, each one being integrally connected with a different one of those contact elements which are adjacently located relative to one of said side walls. Such first terminal connection elements all extend outwardly through such side wall. Also, a plurality of second terminal connection elements are provided, each one being integrally connected with a different one of those contact elements which are remotely located relative to said one side wall. Such second terminal connection elements all extend outwardly through such side wall. Such second connection elements and such first connection elements are coplanar with such contact elements in said housing and in the region where they pass through such one side wall. The connection elements are positioned in spaced relationship to one another. Such first connection elements, including portions exterior of said housing, are offset, and are adapted to locate terminal portions of said first connection elements spatially relative to terminal portions of said second connection elements, all of said terminal portions being in a desired spatial relationship to one another. Such one side wall further includes integrally formed therewith a plurality of laterally outwardly extending spacer bodies. All such spacer bodies are of equal length and are located along opposed side edges of said side wall in spaced relationship to one another. Such spacer bodies have side walls which parallelly extend relative to the floor of the housing. The distance of said spacer bodies extend from such one side wall is less than the distance said first and second connection elements protrude from such one side wall.

Other and further embodiments and variations of the present invention will be apparent to those skilled in the art from the preceding description without departing from the spirit and scope of the present invention.

I claim:

1. In a switch assembly of the type incorporating a plurality of slider switches arranged each one next to another in a block-shaped, elongated housing having generally spaced, parallel side walls, and end walls, and a floor joining said side walls and end walls, each of said slider switches being independently activatable transversely to the longitudinal extension of said housing and parallel to said floor of said housing, and each one having a pair of fixed contacts inset into said floor, each of said contacts being connected in one piece to a terminal connection element which is provided for plugging into holes of a carrier plate, the improvement which comprises having a side wall of such housing extend perpendicularly to the floor thereof, and providing such side wall with a plurality of outwardly extending spacer bodies which extend parallel to said floor and are distributed over side wall edge portions, and further having said terminal connection elements extend from said sidewall in the same direction as said spacer bodies and terminate in a predetermined pattern, said terminal connection elements extending out of said housing coplanarly from said contacts, and being offset from one connection element to another in a staggered manner in the area which is fenced by said spacer bodies.

2. A switch assembly adapted to be mounted adjacently to a plate member, said assembly comprising (A) an elongated housing having generally spaced, parallel side walls, and end walls, a floor joining said side walls and end walls, and a removable cover in spaced relationship to said floor, (B) a plurality of slidable switch subassemblies, each one of said subassemblies being operable independently from the others thereof, each one being transversely positioned interiorly of said housing in longitudinally spaced relationship to one another relative to said housing and adapted for transverse sliding movement between two positions, each one further including (1) an electrically insulative slider member, and (2) an electrically conductive contact bridge, (C) a pair of flattened, electrically conductive contact elements for each one of said switch subassemblies in said housing each one of said pair of contact elements being in transversely spaced, coplanar relationship relative to the other thereof and adapted to have respective surface portions of each engaged by said contact bridge of each said switch subassembly when said switch subassembly is in one of said positions only, (D) a plurality of first terminal connection elements each one integrally connected with a different one of those contact elements which are adjacently located relative to one of said side walls and which extend outwardly therethrough, (E) a plurality of second terminal connection elements, each one integrally connected with a different one of those contact elements which are remotely located relative to said one side wall and which extend outwardly therethrough, said second connection elements and said first connection elements being coplanar with said contact elements in said housing, (F) said first connection elements including exteriorly of said housing an offset region adapted to translate terminal portions of said first connection elements spatially relative to terminal portions of said second connection elements, all of said terminal portions being in a desired spatial relationship to one another, and adapted to provide each one of said switch subassemblies with an operating side extending generally normally to a said plate member located adjacently to said one side wall, (G) said one side wall further including integrally formed therewith a plurality of laterally outwardly extending spacer bodies, all spacer bodies being of equal length and located along opposed side edges of said side wall in spaced relationship to one another, said spacer bodies having side walls which parallelly extend relative to said floor, the length of said spacer bodies being less than the distance said first and second connection elements protrude from said one side wall, said spacer bodies defining a space between said housing and a said plate member adjacently located thereto, said plate member having apertures defined therein which are generally alignable with said first terminal connection elements and through each individual one of which a different one of said first terminal connection elements extends when said plate member is so adjacently located thereto.

* * * * *